US007168416B2

(12) United States Patent
Powell et al.

(10) Patent No.: US 7,168,416 B2
(45) Date of Patent: Jan. 30, 2007

(54) MULTI-POINT GROUNDING PLATE FOR FUEL PUMP MODULE

(75) Inventors: Patrick Powell, Farmington Hills, MI (US); Akiyoshi Mukaidani, West Bloomfield, MI (US)

(73) Assignee: Denso International America, Inc., Southfield, MI (US)

( * ) Notice: Subject to any disclaimer, the term of this patent is extended or adjusted under 35 U.S.C. 154(b) by 163 days.

(21) Appl. No.: 11/087,877

(22) Filed: Mar. 23, 2005

(65) Prior Publication Data

US 2006/0213486 A1 Sep. 28, 2006

(51) Int. Cl.
*F02M 37/04* (2006.01)
*H01R 4/66* (2006.01)

(52) U.S. Cl. ..... 123/509; 439/92

(58) Field of Classification Search ..... 123/509; 439/92, 939

See application file for complete search history.

(56) References Cited

U.S. PATENT DOCUMENTS 6,890,190 B1 * 5/2005 Jurcak et al. ..... 439/92
7,074,058 B2 * 7/2006 Jurcak et al. ..... 439/92

* cited by examiner

*Primary Examiner*—Thomas Moulis
(74) *Attorney, Agent, or Firm*—Harness, Dickey & Pierce, PLC

(57) ABSTRACT

A fuel pump module has a flange located proximate to the top of the fuel tank, a first strut rod, a second strut rod, a fuel inlet tube and a fuel outlet tube, each extending through the flange from a first side of the flange to a second side of the flange. A multi-point grounding plate is located on a side of the flange to contact and ground the strut rods, fuel tubes and adjacent parts. The grounding plate is generally disposed about a periphery of the flange, and a grounding wire, a first end of which is disposed on the grounding plate and a second end of which is disposed on a vehicle ground location, provides the necessary grounding path for the grounding plate.

19 Claims, 4 Drawing Sheets

MULTI-POINT GROUNDING PLATE FOR FUEL PUMP MODULE

FIELD OF THE INVENTION

The present invention relates to fuel pump modules and more specifically, to a multi-point grounding plate located on a fuel pump module flange for grounding parts of the fuel pump module.

BACKGROUND OF THE INVENTION

Parts that comprise automobile fuel pump modules are typically grounded in order to dissipate any static electricity buildup in the various parts of the fuel pump module that may contact liquid fuel or gaseous fuel fumes. Traditionally, fuel pump modules have various electrically conductive parts that each require a grounding wire to ensure that those parts are grounded since those parts might contact liquid fuel or any surrounding gaseous fumes of the liquid fuel. Typically, the top fuel pump module flange is mounted to the top of a fuel tank while the grounding wires are connected to an appropriate grounding point in order to fully connect conductive parts of the fuel pump module to ground.

A major disadvantage of the current fuel pump module grounding method is that multiple grounding wires, each coming from a component of or around the fuel pump module, are required. Because multiple wires are required, this technique is less efficient in terms of wiring and results in higher costs and longer assembly times. Additionally, with multiple wires, multiple points of wire disconnect may result, which may result in a higher probability that the parts of the fuel pump module will not be grounded at some point during their use.

While current fuel pump modules are suitable for their intended purpose, there is room in the art for improvement. Accordingly, the teachings of the present invention do not suffer from the above disadvantages and therefore, provide a multi-point grounding plate for a fuel pump module that reduces the number of grounding wires necessary to build a conductive fuel pump module by including a grounding plate to the fuel pump module that connects two or more components that each traditionally required a grounding wire. The grounding plate has a grounding wire that connects to a vehicle ground location, thus grounding all parts that contact the grounding plate.

SUMMARY OF THE INVENTION

A multi-point grounding plate of a fuel pump module flange is provided. A fuel pump module flange has a top plate with first and second strut rods that extend through the top plate. A grounding plate is positioned on a bottom side of the fuel pump module top plate, with the grounding plate contacting the first and the second strut rods. The fuel pump module flange also has a fuel inlet tube and a fuel outlet tube that pass through the top plate. The first strut rod, second strut rod, fuel inlet tube, and fuel outlet tube extend through and contact the grounding plate. The fuel pump module flange also has a first strut rod spring surrounding and contacting the first strut rod and a second strut rod spring surrounding and contacting the second strut rod which results in grounding of the springs. A grounding wire connects the grounding plate to an appropriate ground.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 5:
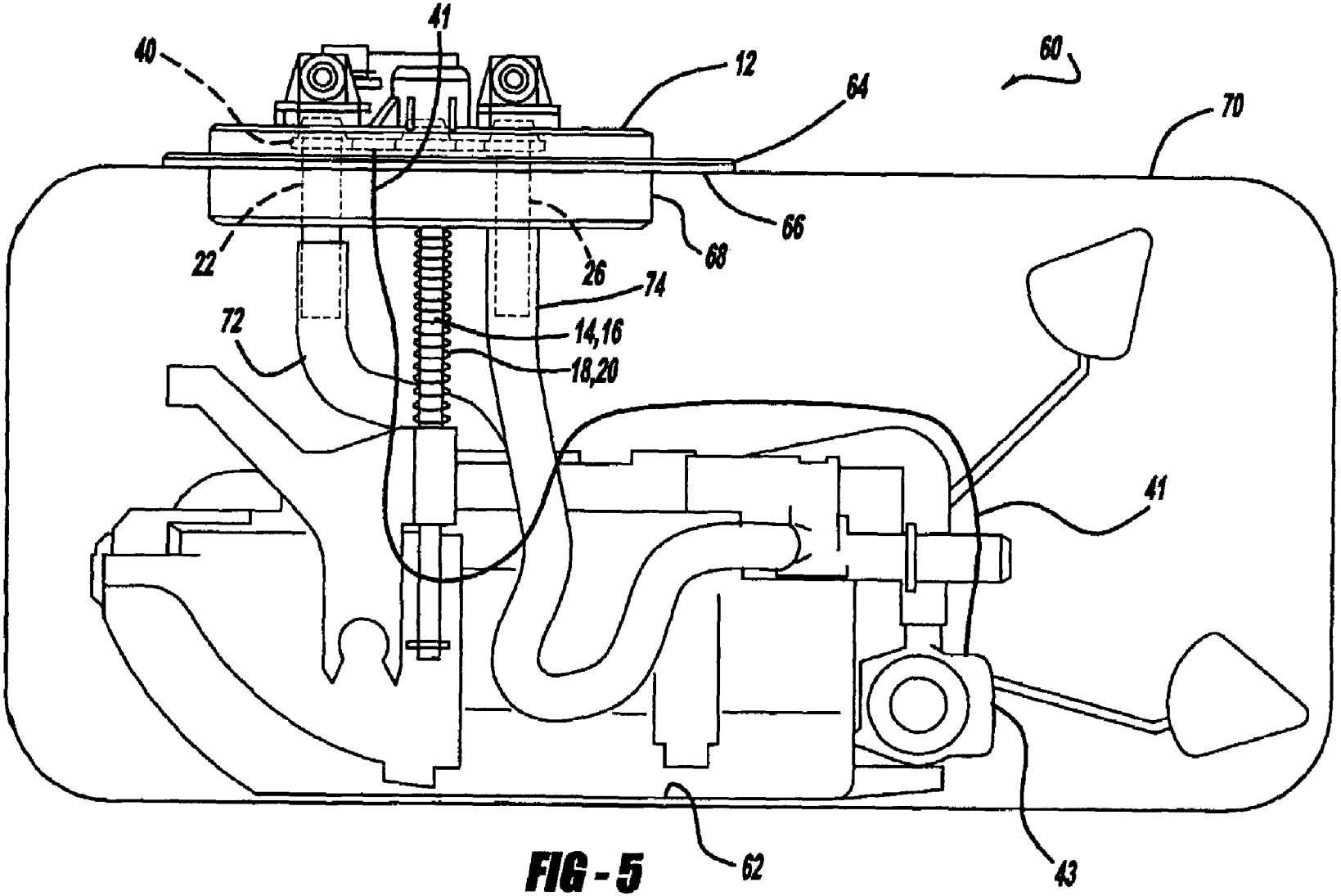
FIG. 5 is a side view of a fuel pump module depicting the multi-point grounding plate on a bottom side of the flange according to the teachings of the present invention.

The following description of the preferred embodiments is merely exemplary in nature and is in no way intended to limit the invention, its application, or uses. Turning now to the Figures, the operative workings of the teachings of the present invention will be described. FIG. 5 is a side view of a fuel pump module 60 that depicts a multi-point grounding plate 40 on a bottom side of the fuel pump module flange 10 (FIG. 1) according to the teachings of the present invention. FIG. 5 also depicts a reservoir 62 that resides within a fuel tank 70, which is connected to the flange 64. The reservoir 62 is connected to the fuel pump module flange 10 by fuel lines 72, 74. Fuel line 72 is a return fuel line that delivers fuel from outside the fuel tank 70 to inside the fuel tank 70, while fuel line 74 is a fuel out line that delivers fuel from inside the fuel tank 70 to the vehicle engine (not shown). The struts or rods 14, 16 are typically metal that are each surrounded by a spring 18, 20. The springs 18, 20 bias against the flange 10 and the reservoir 62 to ultimately bias the reservoir 62 against the interior of the bottom wall of the fuel tank 70.

The flange skirt 68 partially overlaps and partially surrounds the tubes 22, 26 within the fuel tank 70 while the flange seal surface 66 of the fuel pump module flange 10, abuts against the top side of the fuel tank 70. The flange upset 12 resides outside of the fuel tank 70 and is part of the flange upset 12. Against the inside surface of the flange upset 12, that is, against the top plate, resides the multi-point grounding plate 40, which is the subject of the teachings of the present invention.

Figure 1:
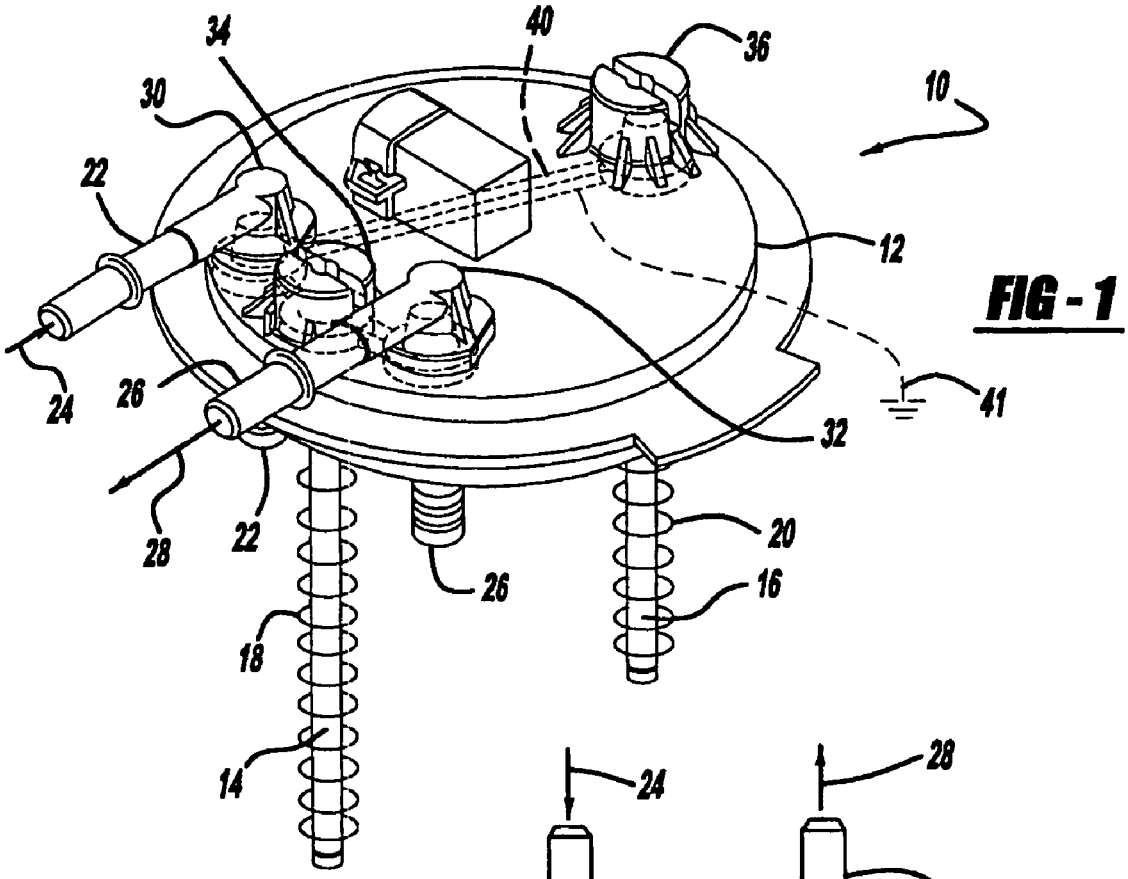
FIG. 1 is a perspective view of a fuel pump module flange and top plate depicting, in phantom, the location of a grounding plate and a grounding wire according to teachings of the present in invention.
Figure 2:
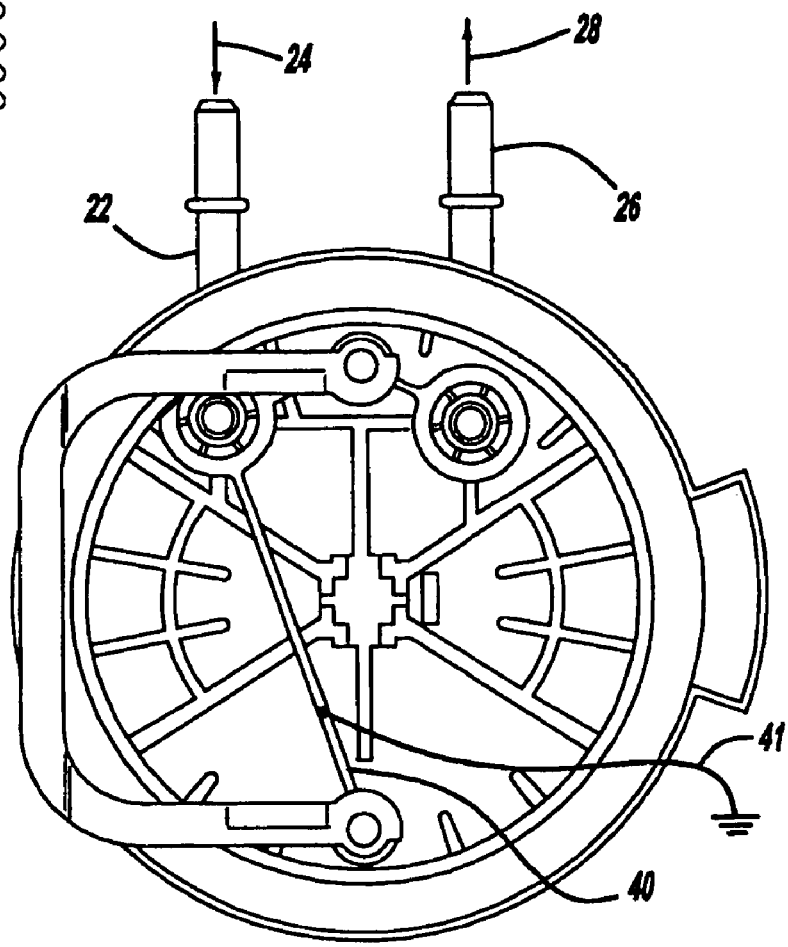
FIG. 2 is a bottom view of the fuel pump module flange depicting the location of the multi-point grounding plate and grounding wire according to the teachings of the present invention.

FIG. 1 is a perspective view of a fuel pump module flange 10 depicting, in phantom, the location of the multi-point grounding plate 40 according to the teachings of the present in invention. As depicted in FIGS. 1 and 2, the grounding plate 40 spans from the second strut 16 to the fuel inlet tube 22 and then from the fuel inlet tube 22 to the first strut 14 and finally onto to the fuel outlet tube 26. The grounding plate 40 is located on the bottom side of the fuel pump module flange 10, and more specifically, as can be seen in FIG. 5, not only under the flange upset 12, but within the confines of the flange 64. While the grounding plate 40 is a relatively small piece compared to the overall size of the fuel pump module 60, it is capable of grounding multiple pieces of the fuel pump module 60 within and around the fuel tank. The grounding plate 40 is also capable of grounding pieces outside the fuel tank. An advantage of having the grounding plate 40 within and around the fuel tank 70 and fuel pump module 60 is that the grounding plate 40 can be used to electrically ground to items that come into contact with liquid fuel or gaseous fuel fumes.

The grounding plate 40 of the fuel pump module 60 makes physical contact with multiple pieces of the fuel pump module 60 to give the grounding plate 40 one of its distinct advantages, which is to provide a ground to multiple pieces, and more specifically, to provide a ground to multiple parts without using multiple grounding wires. If the internal circumference of each hole is not able to directly contact the part to be grounded, then the part to be grounded will contact a part that directly contacts the grounding plate.

Figure 6:
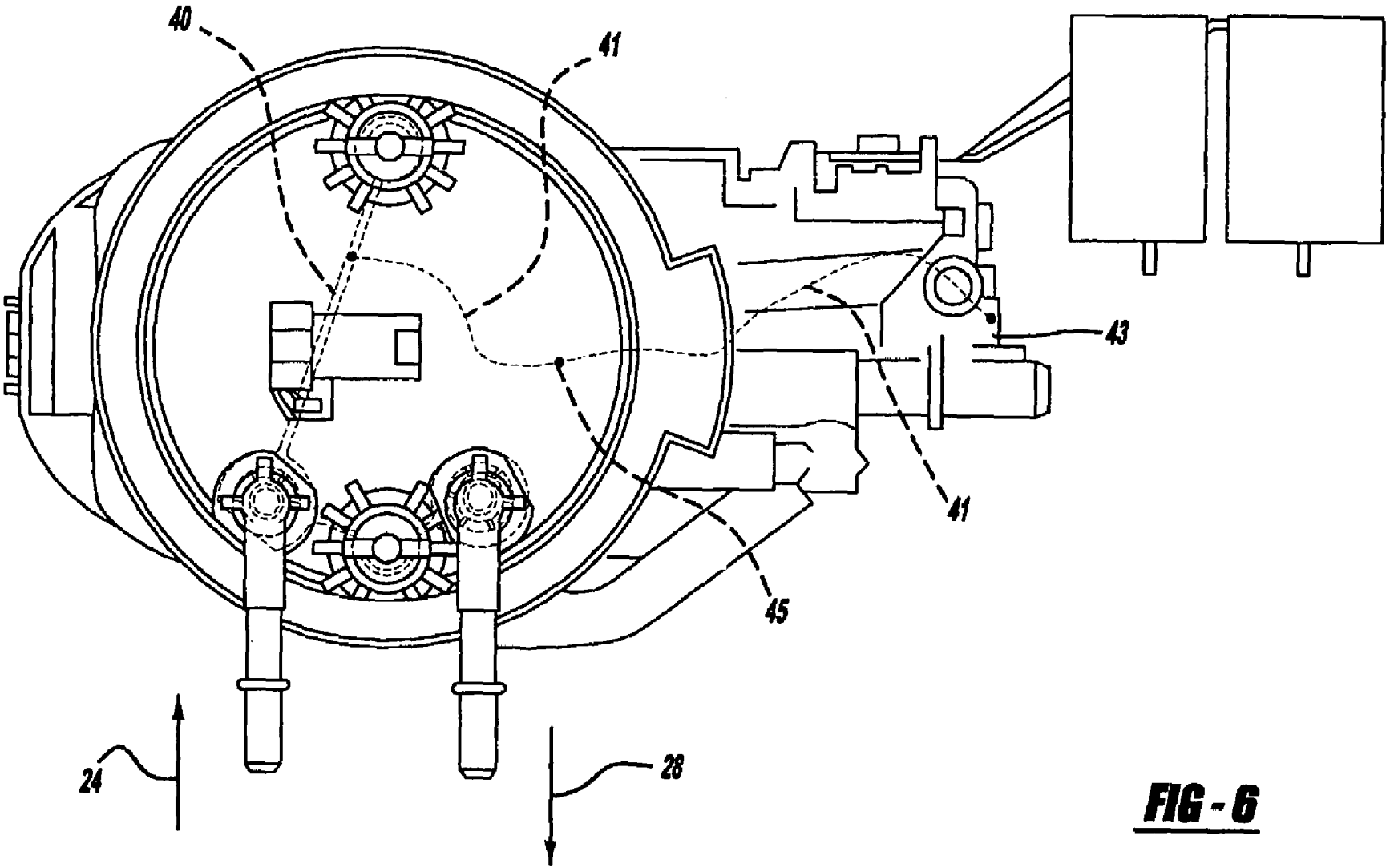
FIG. 6 is a top view of the fuel pump module depicting the fuel inlet and outlet tubes, and in phantom, the multi-point grounding plate under the fuel pump module flange according to the teachings of the present invention.

With specific reference to FIGS. 1, 3 and 4, and general reference to FIGS. 2, 5 and 6, the parts of the fuel pump module 60 to be grounded to the grounding plate 40 will be explained. The grounding plate 40 has an elongated first strut passage 42 to provide space for adjustment of the first strut rod 14 that passes through the strut passage 42. The first strut rod 14 is surrounded by a first strut spring 18 that coils around the first strut rod 14 and provides a biasing force against the reservoir 62. The grounding plate 40 has an elongated second strut passage 44 to provide space for adjustment of the second strut rod 16 that passes through the second strut passage 44. The second strut rod 16 is surrounded by a second strut spring 20 that coils around the second strut rod 16 and provides a biasing force against the reservoir 62. In conjunction with the strut rods 14, 16, the strut springs 18, 20 cause the biasing of the reservoir 62 toward the bottom of the fuel tank 70. Because each strut spring 18, 20 contacts a respective strut rod 14, 16, the strut springs 18, 20 are also grounded to the grounding plate 40. A first strut cap 34 is located at and contacts the top end of the first strut rod 14 while a second strut cap 36 is located at and contacts the top end of the second strut rod 16.

The grounding plate 40 has a fuel inlet tube passage 46 and a fuel outlet tube passage 48. Through these passages 46, 48, a fuel inlet tube 22 and a fuel outlet tube 26, respectively, pass. The fuel inlet tube 22 delivers fuel in the direction of arrow 24, which is in the return direction, that is, from the vehicle engine to the fuel tank 70, while the fuel outlet tube 26 delivers fuel in the direction of arrow 28, which is from the reservoir 62 within the fuel tank 70 to the vehicle engine. The fuel inlet tube 22 and the fuel outlet tube 26, by way of their contact with the grounding plate 40, are grounded to the grounding plate 40. The fuel inlet tube cap 30 and the fuel outlet tube cap 32, because of their respective connection to the fuel inlet tube 22 and the fuel outlet tube 26, respectively, are also grounded to the grounding plate 40.

Figure 3:
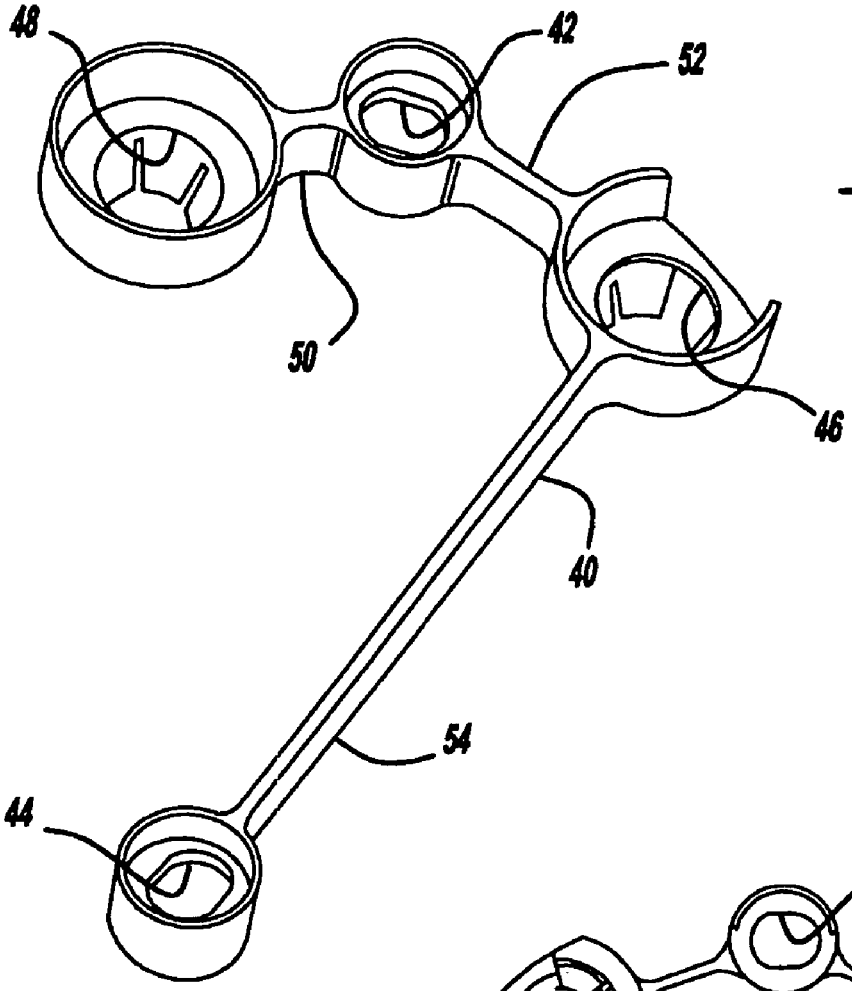
FIG. 3 is a top view of the multi-point grounding plate according to teachings of the present invention.
Figure 4:
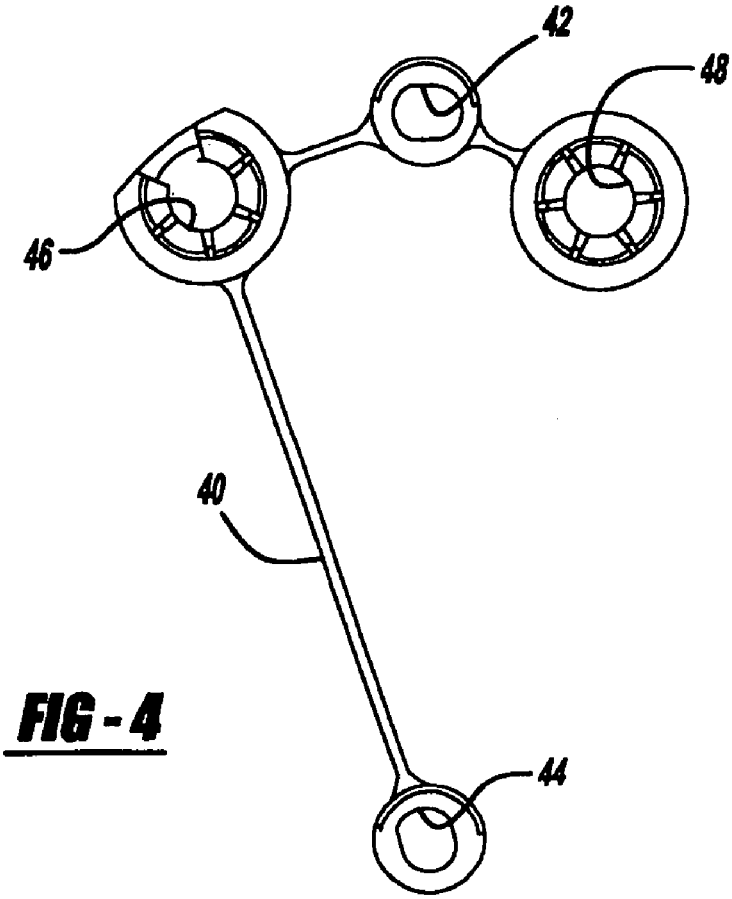
FIG. 4 is a bottom view of the multi-point grounding plate according to teachings of the present invention.

Turning now to FIGS. 3 and 4, the grounding plate 40 will be more specifically described. The grounding plate 40 is generally formed with a top portion and a stem portion. The fuel outlet tube passage 48, the first connector portion 50, the first strut rod passage 42, the second connector portion 52 and the fuel inlet tube passage 46 form the top portion of the grounding plate. The stem portion, which is the portion that connects to the top portion, is formed by the third connector portion 54 and the second strut rod passage 44. Together, the top portion and the stem portion generally form a "T" shape, although the third connector portion 54 connects to the top bar portion in a non-perpendicular fashion. While the grounding plate shown and described is generally "T-shaped," the grounding plate 40 is not limited to such a shape and can be of any shape that is suitably accommodated within and around the fuel pump module flange 10.

Continuing with the description of the grounding plate 40, the third connector portion 54 passes across and adjacent to the bottom surface of the flange upset 12 of the fuel pump module flange 10 in order to provide a location for a grounding wire 41, which provides a grounding path from the grounding plate 40 to a vehicle ground location, which in FIGS. 1 and 2 is denoted by the universal symbol for ground. According to the teachings of the present invention, a vehicle ground location can be the regulator pod 43. With the grounding wire 41 connected to the regulator pod 43, a grounding path is provided from the regulator pod 43 to the grounding plate 40. Although in FIG. 5, the grounding wire 41 defines a grounding path from the grounding plate 40 directly to ground 43, the grounding wire 41 may also connect to, and thereby ground, a part in between these two locations, as is shown in FIG. 6 by grounding point 45, which is located under the fuel pump module flange 10. The grounding wire 41 may contact parts to be grounded between its grounded end and another end. Additionally, while the grounding wire 41 is shown as a single wire having just two ends, it will be appreciated that the grounding wire 41 may be formed in a "Y" shape and have more than two end points that may be used for grounding parts.

With continued reference to FIGS. 3 and 4, slotted portions are depicted about the periphery of the fuel inlet tube passage 46 and the fuel outlet tube passage 48. The slotted portions provide flexibility to the fuel tube passages 46, 48, which permits biased expansion of the respective holes and thus, a more secure and form-fitting grip around the fuel inlet and outlet tubes.

With the grounding plate 40 in place, the grounded items consist of, but are not limited to, the flange upset 12, the fuel ports, strut rods 14, 16, strut rod springs 18, 20, fuel inlet tube 22, fuel outlet tube 26, and the regulator pod 43. If desired and necessary, other fuel pump module parts may be connected to the grounding plate 40 in order to provide a grounding path. A typical grounding path is from a strut rod 14, 16 to its respective strut rod spring 18, 20 and then to the grounding plate 40 by contact. The grounding of the fuel system parts is necessary due to the potential buildup of static electricity by the parts of the fuel pump module 60 that are associated with the liquid fuel environment.

Static electricity, which is electricity at rest, is an electrical charge that is the result of a transfer and buildup of electrons that may occur due to the sliding or rubbing of a material, which is a prime generator of electrostatic voltages—e.g.: plastics, fiber glass, rubber, textiles, etc. Under particular conditions, this induced charge can build to a very high potential voltage. When this happens to an insulating material, such as a plastic, the built-up charge tends to remain in the localized area of contact. This electrostatic voltage then can discharge via an arc or spark when the plastic material comes in contact with a body at a sufficiently different potential, such as a surrounding part. The grounding plate 40 will remove any such static charge.

With regard to the material of the grounding plate, plastic or metal may be used, although the preferred material is a conductive plastic that is capable of carrying an electric charge. Generally, plastic parts are lightweight, inexpensive and simple to manufacture in comparison with their metal counterparts. An example of such a plastic that is capable of carrying an electric charge is conductive polyoxymethylene ("POM"). POM plastics are based on polymers in which the repeating unit is oxymethylene. Furthermore, POM is a rigid thermoplastic polymer in the family of plastic having highly crystalline thermoplastic polymers and has properties similar to zinc, aluminum, and other metals. The molecular structure of the polymer is of a linear acetal consisting of unbranched polyoxymethylene chains.

Advantages of the grounding plate 40 are its ability to be made from a lightweight, electrically conductive material such as plastic. Another advantage is the grounding plate's ability to ground multiple pieces of the fuel pump module 60 with a single module piece. Additionally, even though the grounding plate 40 is capable of grounding multiple pieces of the fuel pump module 60, only a single grounding wire leading from the grounding plate 40 to ground is necessary. A further advantage is that since the grounding plate 40 may be plastic, additional parts of the fuel pump module may also be plastic. This will result in an overall weight reduction of vehicles utilizing the plastic grounding plate and fuel pump module.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel pump module flange comprising:

a top plate;

a first strut rod extending through the fuel pump module top plate;

a second strut rod extending through the fuel pump module top plate; and a grounding plate positioned on a bottom side of the fuel pump module top plate, wherein the grounding plate contacts the first and the second strut rods.

2. The fuel pump module flange of claim 1, further comprising:

a fuel inlet tube, wherein the fuel inlet tube passes through the top plate.

3. The fuel pump module flange of claim 2, further comprising:

a fuel outlet tube, wherein the fuel outlet tube passes through the top plate.

4. The fuel pump module flange of claim 3, wherein the first strut rod, second strut rod, fuel inlet tube, and fuel outlet tube extend through and contact the grounding plate.

5. The fuel pump module flange of claim 1, further comprising:

a fuel inlet tube; and a fuel outlet tube, wherein the grounding plate contacts the fuel inlet tube and the fuel outlet tube.

6. The fuel pump module flange of claim 5, further comprising:

a first strut rod spring surrounding and contacting the first strut rod; and a second strut rod spring surrounding and contacting the second strut rod.

7. The fuel pump module flange of claim 6, wherein the strut rod springs are electrically grounded to the grounding plate.

8. A fuel pump module comprising:

a fuel pump module flange;

a first strut rod extending through the flange from a first side of the flange to a second side of the flange;

a second strut rod extending through the flange from the first side of the flange to the second side of the flange;

a fuel inlet tube that extends through the flange from the first side of the flange to the second side of the flange;

a fuel outlet tube that extends through the flange from the first side of the flange to the second side of the flange; and a plate used for grounding that contacts the first strut rod, the second strut rod, the fuel inlet tube and the fuel outlet tube.

9. The fuel pump module of claim 8, further comprising:

a first spring coiled around the first strut rod; and a second spring coiled around the second strut rod.

10. The fuel pump module of claim 8, wherein the plate used for grounding grounds the fuel pump module, the first strut rod, the second strut rod, the fuel inlet tube and the fuel outlet tube.

11. The plate used for grounding of claim 8, wherein the plate defines a hole for the first strut passage, a hole for the second strut passage, a hole for the fuel inlet tube and a hole for the fuel outlet tube.

12. The plate used for grounding of claim 11, wherein the plate portion around the hole for the fuel inlet tube and the plate portion around the hole for the fuel outlet tube is slotted.

13. The plate used for grounding of claim 8, further comprising:

a grounding wire connected to the plate and a vehicle ground location.

14. A fuel pump module flange comprising:

a fuel inlet tube that extends through the flange from a first side of the flange to a second side of the flange;

a fuel outlet tube that extends through the flange from a first side of the flange to a second side of the flange;

a grounding plate that connects and grounds the first and second fuel tubes, wherein said grounding plate is disposed on a side of said flange; and a grounding wire, a first end of which is connected to the grounding plate and a second end of which is connected to a vehicle ground location.

15. The fuel pump module flange of claim 14, further comprising:

a first strut rod extending through the flange from a first side of the flange to a second side of the flange; and a second strut rod extending through the flange from a first side of the flange to a second side of the flange, wherein the first and second strut rods contact the grounding plate and are grounded to the grounding plate.

16. The fuel pump module flange of claim 15, further comprising:

a first strut spring surrounding the first strut rod; and a second strut spring surrounding the second strut rod, wherein the first and second strut springs contact the grounding plate and are grounded to the grounding plate.

17. The grounding plate of claim 14, wherein the grounding plate defines holes through which the fuel inlet tube, fuel outlet tube, first strut rod, and second strut rods pass.

18. The grounding plate of claim 17, wherein the holes through which the fuel inlet tube and the fuel outlet tube pass, are surrounded by material that is slotted to permit flexibility and a tight fit around the inlet and outlet tubes.

19. The grounding plate of claim 18, wherein the grounding plate is confined within an outer perimeter of a top plate of the fuel pump module flange.

* * * * *